US011213718B1

(12) United States Patent
Tipple et al.

(10) Patent No.: US 11,213,718 B1
(45) Date of Patent: Jan. 4, 2022

(54) PORTABLE ROWING MACHINE

(71) Applicants: Luke Tipple, Oceanside, CA (US); David Riley, Markham (CA); Tiziano Cousineau, Toronto (CA)

(72) Inventors: Luke Tipple, Oceanside, CA (US); David Riley, Markham (CA); Tiziano Cousineau, Toronto (CA)

( * ) Notice: Subject to any disclaimer, the term of this patent is extended or adjusted under 35 U.S.C. 154(b) by 0 days.

(21) Appl. No.: 17/086,122

(22) Filed: Oct. 30, 2020

Related U.S. Application Data

(60) Provisional application No. 63/045,553, filed on Jun. 29, 2020.

(51) Int. Cl.

| | |
|---|---|
| ***A63B 22/00*** | (2006.01) |
| ***A63B 21/22*** | (2006.01) |
| ***A63B 21/00*** | (2006.01) |
| ***A63B 71/06*** | (2006.01) |
| ***A63B 24/00*** | (2006.01) |
| ***A63B 71/04*** | (2006.01) |
| ***A63B 71/00*** | (2006.01) |

(52) U.S. Cl.
CPC .... *A63B 22/0076* (2013.01); *A63B 21/00069* (2013.01); *A63B 21/00192* (2013.01); *A63B 21/154* (2013.01); *A63B 21/225* (2013.01); *A63B 21/4035* (2015.10); *A63B 24/0062* (2013.01); *A63B 24/0087* (2013.01); *A63B 71/0036* (2013.01); *A63B 71/04* (2013.01); *A63B 71/0619* (2013.01); *A63B 2022/0079* (2013.01); *A63B 2225/055* (2013.01)

(58) Field of Classification Search
CPC ..... A63B 21/00069; A63B 21/00192; A63B 21/154; A63B 21/225; A63B 21/4035; A63B 22/0076; A63B 24/0062; A63B 24/0087; A63B 71/0036; A63B 71/04; A63B 71/0619; A63B 2022/0079; A63B 2225/055
See application file for complete search history.

(56) References Cited

U.S. PATENT DOCUMENTS

| | | | | |
|---|---|---|---|---|
| 4,647,035 A * | 3/1987 | Yellen | A63B 21/153 482/115 |
| 4,880,224 A * | 11/1989 | Jonas | A63B 21/153 482/72 |
| 8,070,657 B2 * | 12/2011 | Loach | A63B 21/225 482/72 |

(Continued)

*Primary Examiner* — Joshua Lee

(57) ABSTRACT

The present invention is a portable rowing machine that allows a user to perform rowing, skiing, paddling, or any other physical activities at any suitable location. The portable rowing machine contains a housing, a pulley, a flywheel, a planetary gear assembly, an anchor, a retraction mechanism, and a pull cord. The housing contains a central gear support. The pulley, the flywheel, the planetary gear assembly, and the retraction mechanism are positioned within the housing. The central gear support is positioned within the housing. The planetary gear assembly is positioned within the central gear support. The pulley and the flywheel are axially connected opposite to each other along the planetary gear assembly. The retraction mechanism is operatively connected to the pulley, where the retraction mechanism is configured to retract the pull cord into a spooled state around the pulley. The anchor is externally connected to the housing.

16 Claims, 9 Drawing Sheets

(56) References Cited

U.S. PATENT DOCUMENTS

| | | | | |
|---|---|---|---|---|
| 10,220,261 | B1 * | 3/2019 | Garsdean | A63B 21/018 |
| 10,471,297 | B1 * | 11/2019 | Smith | A63B 22/0076 |
| 10,556,167 | B1 * | 2/2020 | Machovina | A63B 22/0005 |
| 2009/0036276 | A1 * | 2/2009 | Loach | A63B 21/0055 482/72 |
| 2014/0113779 | A1 * | 4/2014 | Loach | A63B 21/0053 482/115 |
| 2017/0361153 | A1 * | 12/2017 | Machovina | A63B 21/153 |
| 2018/0169463 | A1 * | 6/2018 | Ellis | A63B 21/22 |
| 2019/0099649 | A1 * | 4/2019 | Machovina | A63B 22/0076 |

* cited by examiner

PORTABLE ROWING MACHINE

The current application claims a priority to the U.S. Provisional Patent application Ser. No. 63/045,553 filed on Jun. 29, 2020.

FIELD OF THE INVENTION

The present invention relates generally to a rowing machine exercise apparatus. More specifically, the present invention is a portable rowing machine to simulate rowing, skiing, paddling, and other physical activities.

BACKGROUND OF THE INVENTION

Exercise machines are often bulky and heavy pieces of equipment that can make it difficult for active users to easily move around. More particularly, indoor rowing machines have a large frame in which a user can sit in to more comfortably perform exercises and to simulate the position assumed when rowing a physical boat. However, such a machine is not meant for moving to other positions or for travel. Many of these machines are also only capable of a single type of exercise, specifically a rowing motion which can leave a user wanting for a more diverse workout session.

An objective of the present invention is to create a portable rowing machine capable of several different types of exercises. The portable rowing machine is provided a planetary gearbox and flywheel to provide resistance when pulling an attached rope. To anchor such a device, an inflatable bladder that is hingedly attached to the machine allows the user to insert the bladder underneath the gap of a door or similar. The device may also be anchored by a cord and at least one fastener disposed on the rear of the portable rowing machine wherein the cord may loop around an object such as a tree or fence post. Such anchoring mechanisms allow the user to perform horizontal exercises such as rowing. Furthermore, the portable rowing machine may be anchored in a vertical position to allow the user to perform vertical strokes to simulate skiing using a Y-shaped accessory that may attached to an end of the rope.

SUMMARY OF THE INVENTION

The present invention is a portable rowing machine. The portable rowing machine comprises a housing, a pulley, a flywheel, a planetary gear assembly, an anchor, a retraction mechanism, and a pull cord. The housing comprises a central gear support. The pulley, the flywheel, the planetary gear assembly, and the retraction mechanism are positioned within the housing. The central gear support is positioned within the housing. The planetary gear assembly is positioned within the central gear support. The pulley and the flywheel are axially connected opposite to each other along the planetary gear assembly. The retraction mechanism is operatively connected to the pulley, where the retraction mechanism is configured to retract the pull cord into a spooled state around the pulley. The anchor is externally connected to the housing.

DETAIL DESCRIPTIONS OF THE INVENTION

Figure 1:
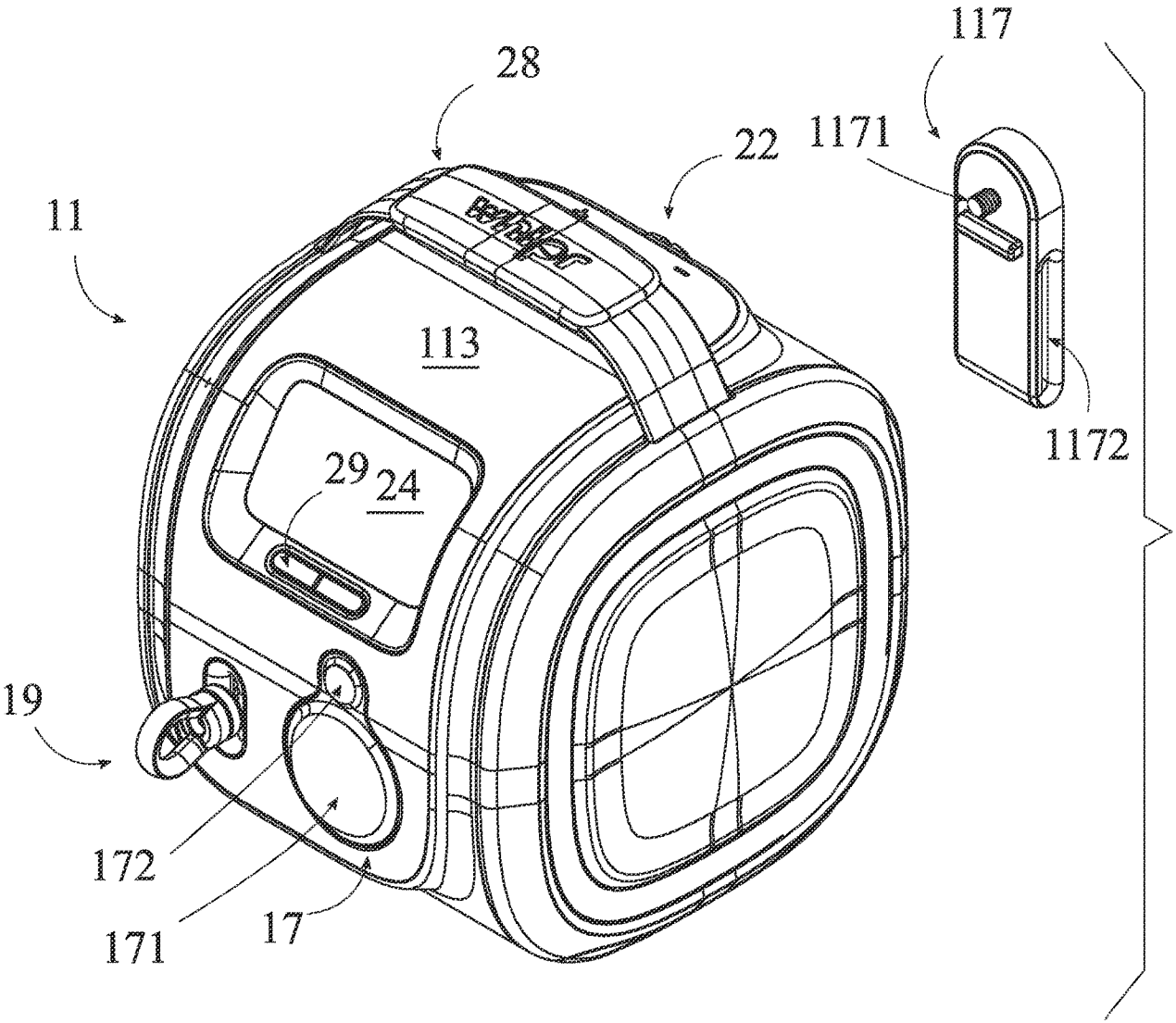
FIG. 1 is a top perspective view of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is a portable rowing machine 1, as shown in FIGS. 1-8. The portable rowing machine 1 comprises a housing 11, a pulley 12, a flywheel 14, a planetary gear assembly 16, an anchor 17, a retraction mechanism 18, and a pull cord 19. The housing 11 comprises a central gear support 111. The pulley 12, the flywheel 14, the planetary gear assembly 16, and the retraction mechanism 18 are positioned within the housing 11. The central gear support 111 is positioned within the housing 11. The planetary gear assembly 16 is positioned within the central gear support 111. The pulley 12 and the flywheel 14 are axially connected opposite to each other along the planetary gear assembly 16. The retraction mechanism 18 is operatively connected to the pulley 12, where the retraction mechanism 18 is configured to retract the pull cord 19 into a spooled state around the pulley 12. The anchor 17 is externally connected to the housing 11. In the preferred embodiment of the present invention, the portable rowing machine 1 allows a user to perform rowing exercises at any suitable location. Additionally, the portable rowing machine 1 is sufficiently compact and lightweight to stow within the user's luggage compartment or any other suitable compartment for travel. In the preferred embodiment of the present invention, the portable rowing machine 1 is made out lightweight and durable material, such as, but not limited to polymer, aluminum, or any other suitable material. The housing 11 secures all the components that constitutes the portable rowing machine 1. In the preferred embodiment of the present invention, the housing 11 is made out of a polymer material but can be made out of any other suitable material. The central gear support 111 serves as the gearbox enclosure for the planetary gear set to secure along the housing 11. The pulley 12 serves as the user engagement portion of the portable rowing machine 1, such that the user pulls along the pull cord 19 to exert rotational energy along the planetary gear assembly 16. The flywheel 14 serves as the primary resistance agent working in conjunction with the planetary gearbox, such that flywheel 14 and the planetary gearbox provides rotational resistance along the pulley 12 when the user pulls on the pull cord 19. The retraction mechanism 18 allows the pull cord 19 to retract back into the pulley 12. The anchor 17 may take the form of any suitable mounting system that secures the portable rowing machine 1 along a rigid surface.

Figure 3:
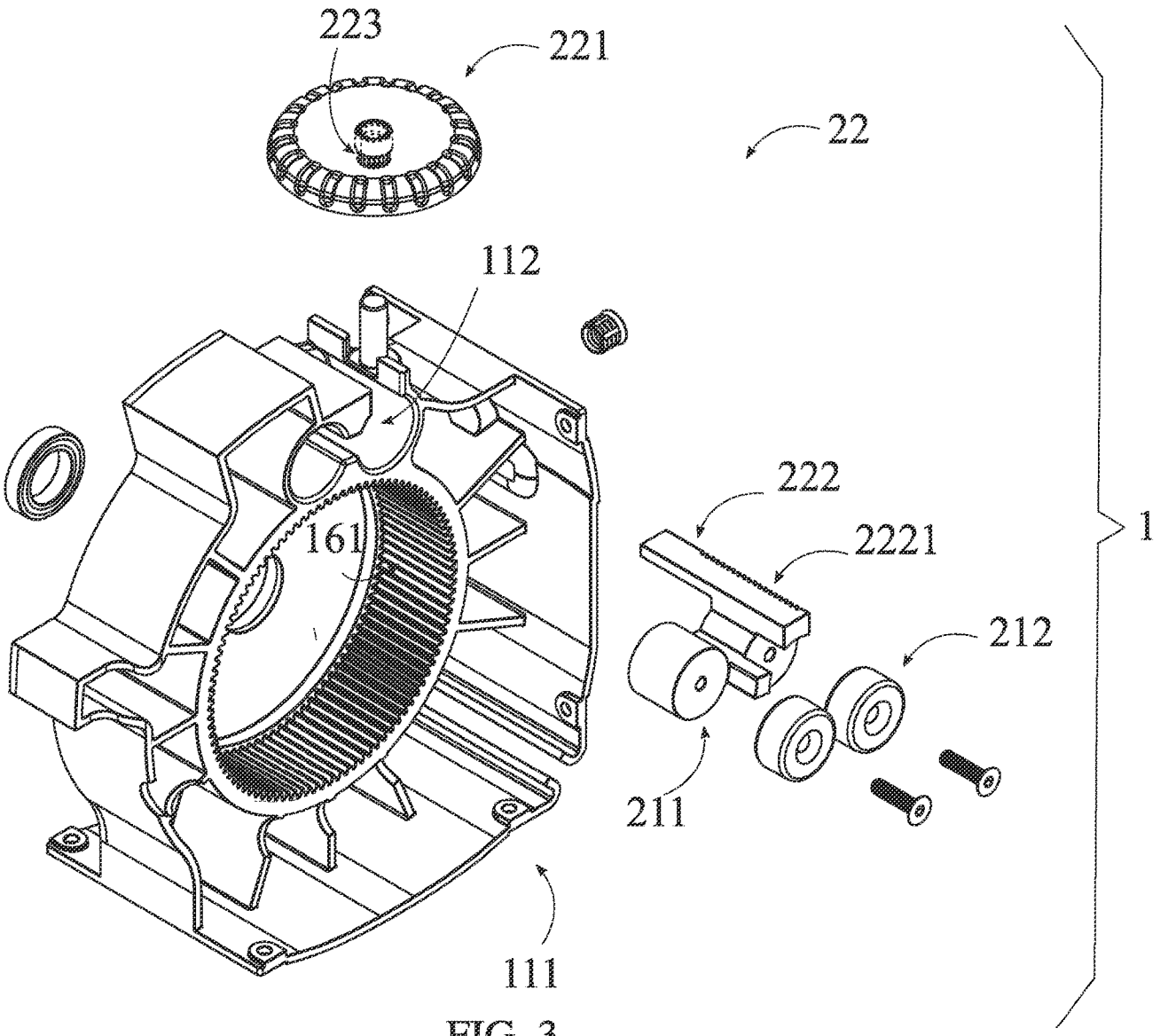
FIG. 3 is an exploded view of the present invention showing a resistance mechanism.

The portable rowing machine 1 further comprises a resistance mechanism 21, as shown in FIG. 3. The resistance mechanism 21 comprises a carriage 211 and at least one magnet 212. The housing 11 further comprises a carriage cavity 112. The carriage 211 is slidably positioned within the carriage cavity 112. The at least one magnet 212 is connected adjacent to the carriage cavity 112. The at least one magnet 212 is operatively engaged to the flywheel 14, where the at least one magnet 212 is configured to provide magnetic resistance along the flywheel 14. In the preferred embodiment of the present invention, the resistance mechanism 21 may take the form of a magnetic induction resistance system, such that the resistance mechanism 21 provides additional pull resistance in conjunction with the planetary gearbox and the flywheel 14. The carriage cavity 112 secures the carriage 211 to the housing 11, such that the carriage 211 slides freely along the carriage cavity 112. In the preferred embodiment of the present invention, each of the at least one magnet 212 may take the form of neodymium rare earth magnets. In the preferred embodiment of the present invention, the flywheel 14 is made out of a magnetic material, such that the flywheel 14 magnetically engages to the at least one magnet 212.

Figure 2:
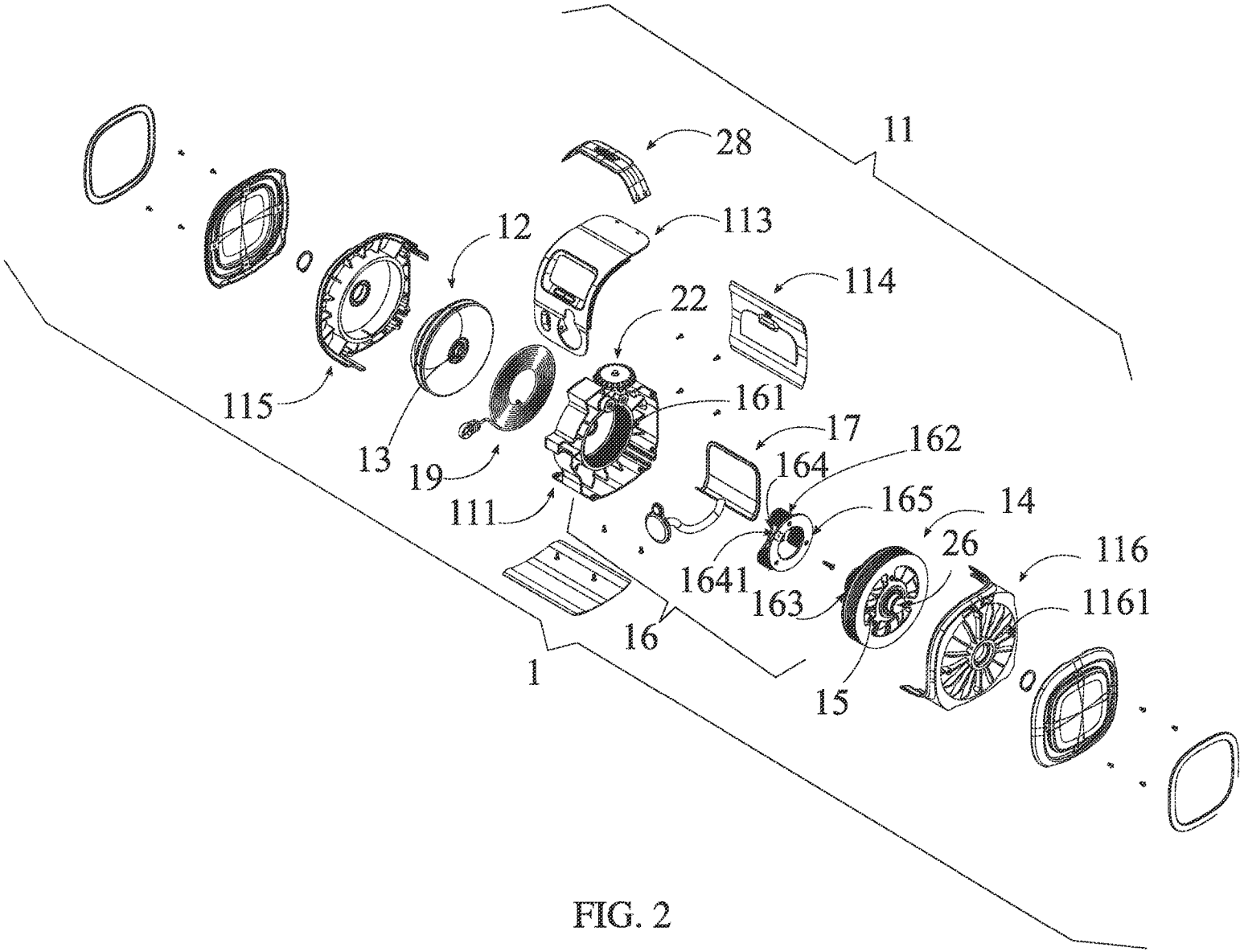
FIG. 2 is an exploded view of the present invention.

The portable rowing machine 1 further comprises an adjustment mechanism 22, as shown in FIGS. 2-3. The adjustment mechanism 22 comprises an adjustment element 221 and a slider 222. The slider 222 is connected adjacent to the carriage 211. The adjustment element 221 is operatively engaged to the slider 222 through the housing 11, where the adjustment mechanism 22 is configured to adjust a distance between the at least one magnet 212 and the flywheel 14. The adjustment mechanism 22 traverses through the housing 11. In the preferred embodiment of the present invention, the adjustment mechanism 22 may take the form of any suitable adjustment mechanism 22 that adjusts and configures the degree of resistance applied by the resistance mechanism 21. The adjustment element 221 may take the form of a user accessible controlling element, such that the user can adjust and configure the degree of resistance applied by the resistance mechanism 21. The slider 222 may take the form of a transmission member that bridges and operatively engages with the carriage 211 such that the degree of resistance is adjusted when the adjustment element 221 is actuated.

In the preferred embodiment of the present invention, the adjustment mechanism 22 further comprises a pinion 223. The slider 222 comprises a rack 2221, as shown in FIG. 3. The pinion 223 is connected adjacent to the adjustment element 221. The rack 2221 traverses across the slider 222. The rack 2221 is operatively engaged with the pinion 223. The adjustment element 221 may take the form of an adjustment dial. The pinion 223 and the rack 2221 may take the form of a rack 2221 and pinion 223 gear system, allowing the carriage 211 to slidably adjust along the carriage cavity 112 to decrease or increase the degree of resistance between the at least one magnet 212 and the flywheel 14.

Figure 8:
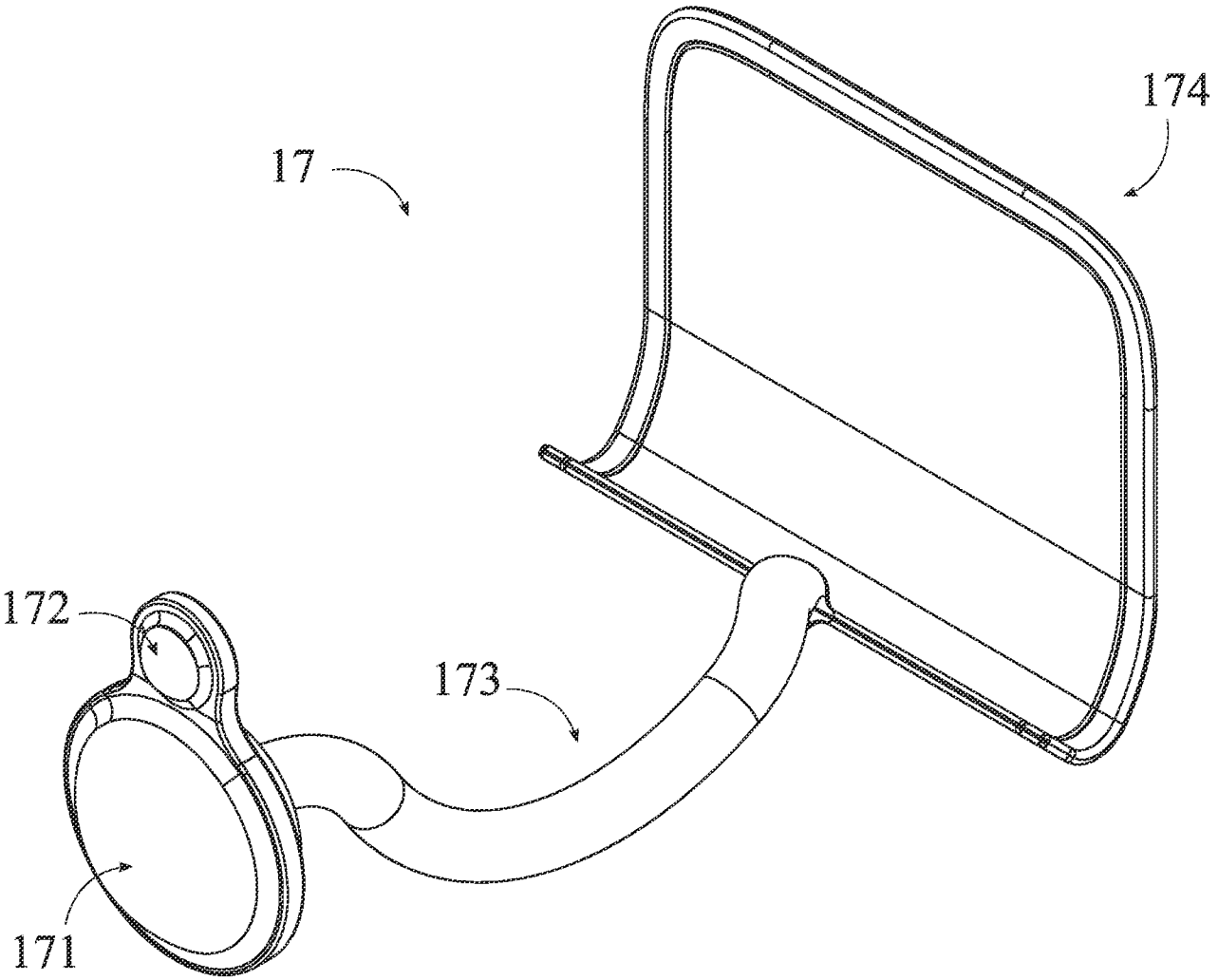
FIG. 8 is a rear perspective view of an anchor used in the present invention.
Figure 9:
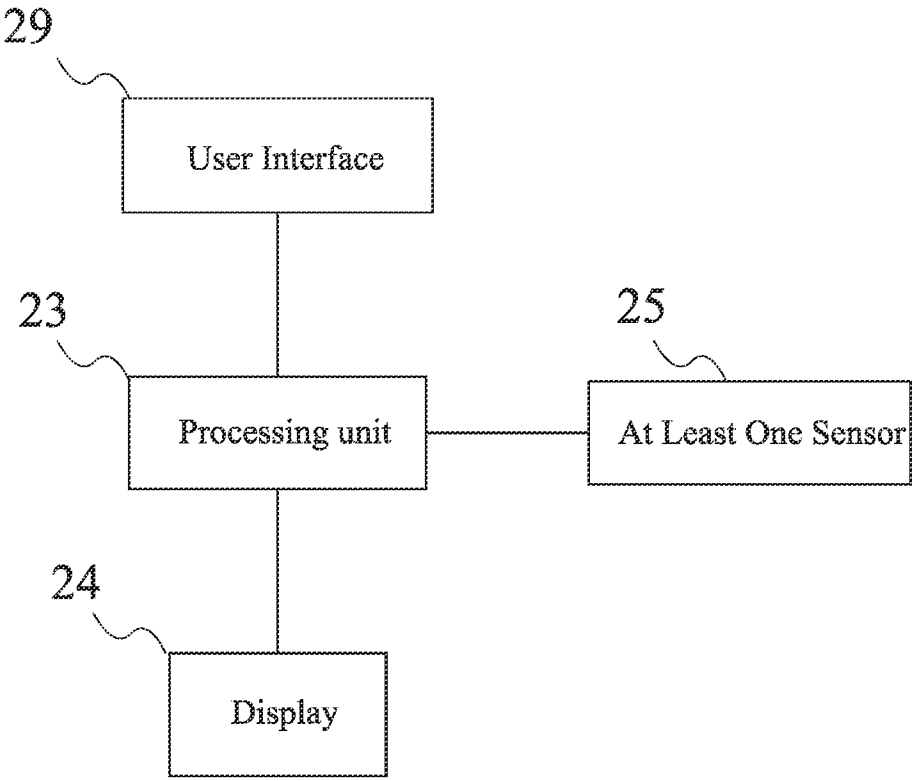
FIG. 9 is a circuit diagram used in the present invention.

The housing 11 further comprises a control panel 113 and a backing 114, as shown in FIGS. 1-2. The anchor 17 comprises an air pump 171, an air release 172, a hose 173, and a bladder 174, as shown in FIGS. 1-2 and 8. The control panel 113 and the backing 114 are terminally positioned opposite to each other along the housing 11. The air pump 171 and the air release 172 are positioned adjacent to the control panel 113. The bladder 174 is positioned adjacent to the backing 114. The air pump 171 and the air release 172 are operatively connected to the hose 173. The hose 173 is in fluid communication between the air pump 171 and the bladder 174. In the preferred embodiment of the present invention, the control panel 113 serves as the user interface 29 portion of the portable rowing machine 1. The backing 114 secures the anchor 17 of the portable rowing machine 1. In the preferred embodiment of the present invention, the anchor 17 may take the form of a pneumatic lock hinge system that secures the portable rowing machine 1 along a closed door. The air pump 171 allows the user to inflate the bladder 174 into a lock configuration. The air release 172 allows the user to deflate the bladder 174 into a release configuration. In the preferred embodiment of the present invention, the bladder 174 is placed between the door and a floor. The bladder 174 is then inflated by the air pump 171 such that the bladder 174 is wedged between the door and the floor, securing the portable rowing machine 1 along the door, allowing the user to perform rowing exercises. Once the rowing exercises are finished, the user can then deflate the bladder 174 by actuating the air release 172 to deflate the bladder 174, allowing the user to remove the bladder 174 from the door.

The housing 11 further comprises a pulley enclosure 115 and a flywheel enclosure 116, as shown in FIG. 2. The pulley enclosure 115 and the flywheel enclosure 116 are connected adjacent to the central gear support 111, opposite to each other along the central gear support 111. The pulley 12 is positioned between the central gear support 111 and the pulley enclosure 115. The flywheel 14 is positioned between the central gear support 111 and the flywheel enclosure 116. The pulley enclosure 115 secures the pulley 12 along the central gear support 111. The flywheel enclosure 116 secures the flywheel 14 along the central gear support 111.

Figure 5:
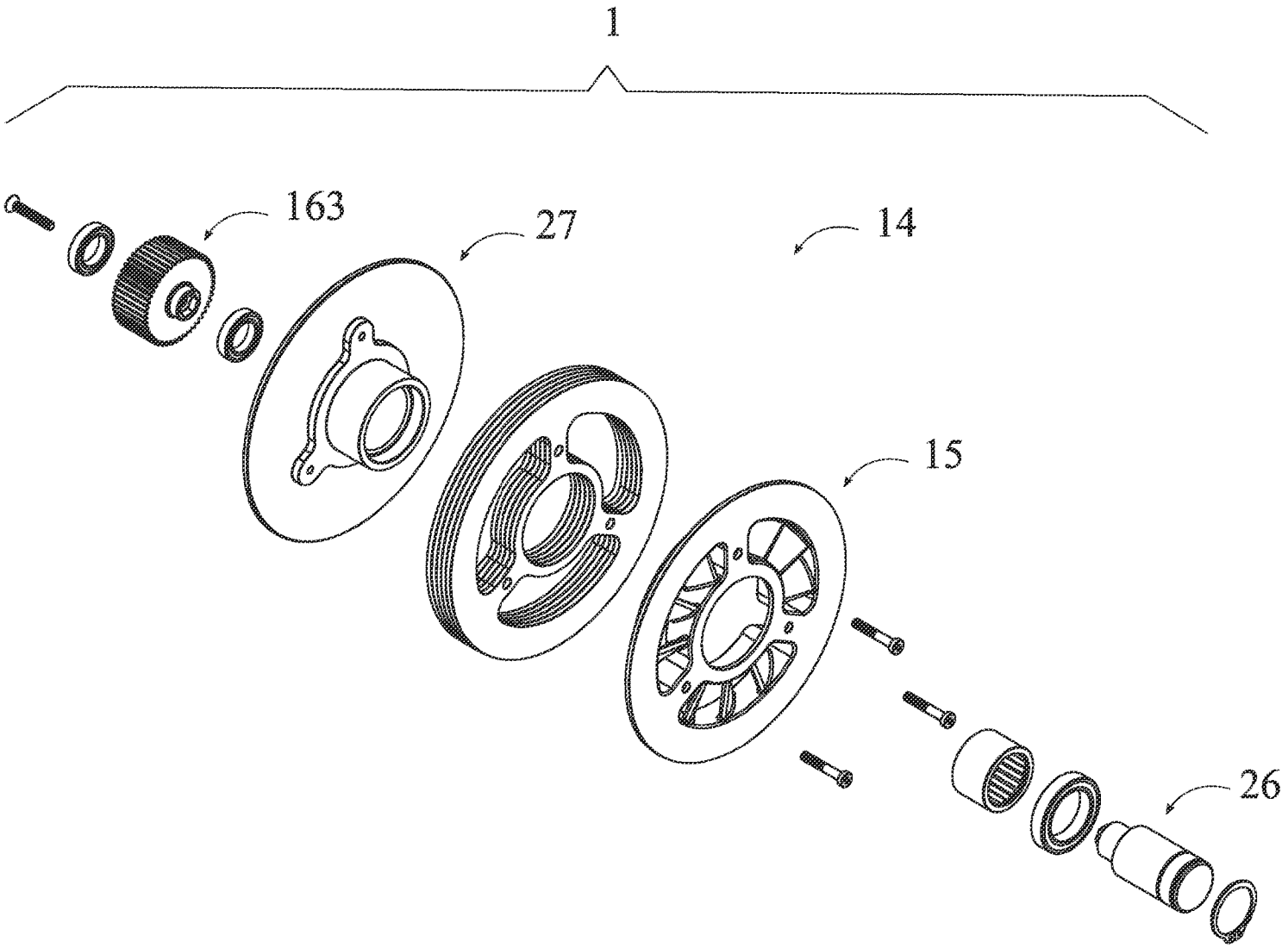
FIG. 5 is an exploded view of the present invention showing a flywheel.

The portable rowing machine 1 further comprises a flywheel fan 15, as shown in FIGS. 2 and 5. The flywheel enclosure 116 comprises a flywheel duct 1161. The flywheel duct 1161 traverses through the flywheel enclosure 116. The flywheel fan 15 is connected to the flywheel 14, opposite to the central gear support 111. The flywheel fan 15 serves a ventilation fan to dissipate heat generated from magnetic induction along the flywheel 14 and the resistance mechanism 21.

The planetary gear assembly 16 comprises an internal gear 161, a plurality of planet gears 162, and a sun gear 163, as shown in FIGS. 2-3 and 5. The internal gear 161 is connected within the central gear support 111. The plurality of planet gears 162 is engaged within the internal gear 161. The sun gear 163 is connected adjacent to the flywheel 14. The sun gear 163 is engaged within the plurality of planet gears 162, where the sun gear 163 is engaged to the internal gear 161 through the plurality of planet gears 162. In the preferred embodiment of the present invention, the planetary gear assembly 16 is configured to a suitable gear ratio, to optimize rotational force transfer from the pulley 12 to the flywheel 14.

Figure 4:
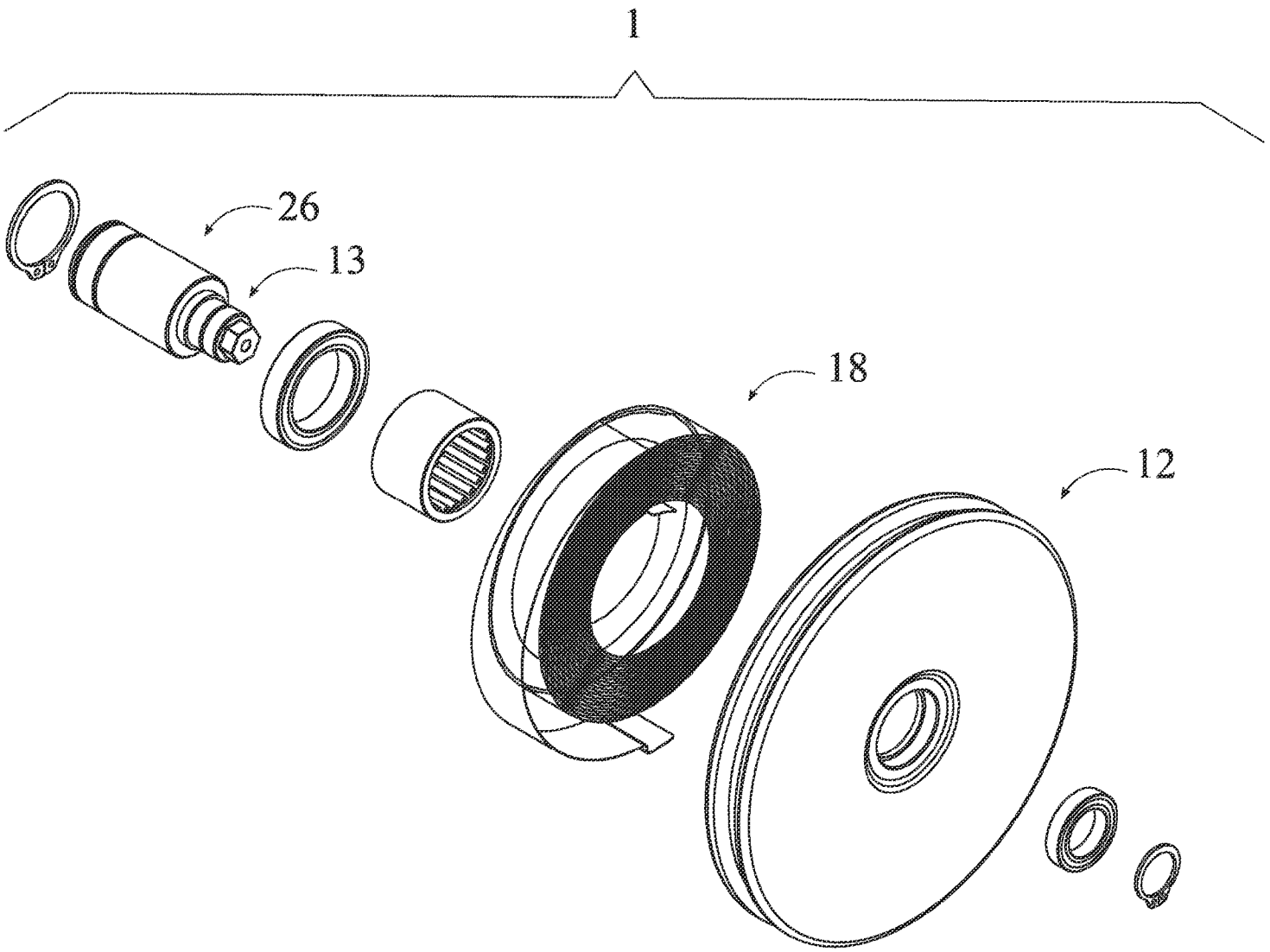
FIG. 4 is an exploded view of the present invention showing a pulley and a retraction mechanism

The portable rowing machine 1 further comprises a pulley shaft 13, as shown in FIGS. 2 and 4. The planetary gear assembly 16 comprises a gear spindle 164 and a gear ring 165. The gear spindle 164 comprises a pulley shaft receiver 1641. The plurality of planet gears 162 is connected between and radially distributed around the gear spindle 164 and the gear ring 165. The pulley shaft 13 is axially connected to the pulley 12. The pulley shaft 13 is axially connected to the pulley shaft receiver 1641.

Figure 6:
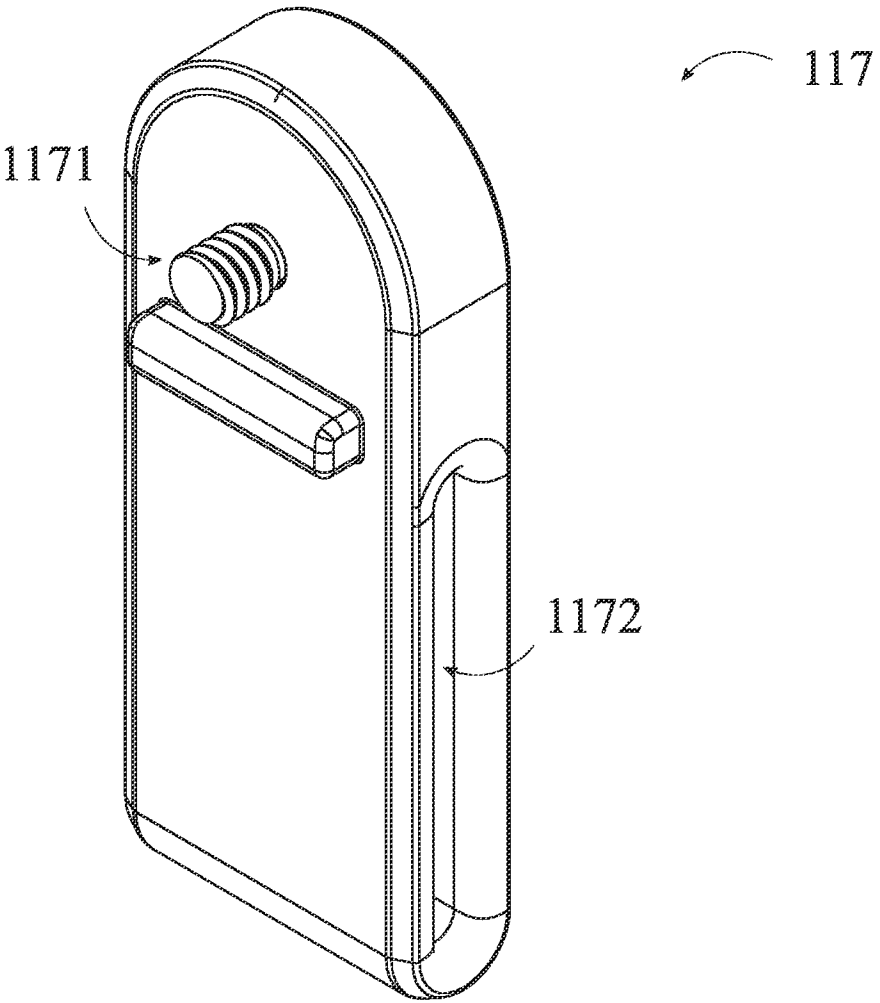
FIG. 6 is a rear perspective view of a clip.
Figure 7:
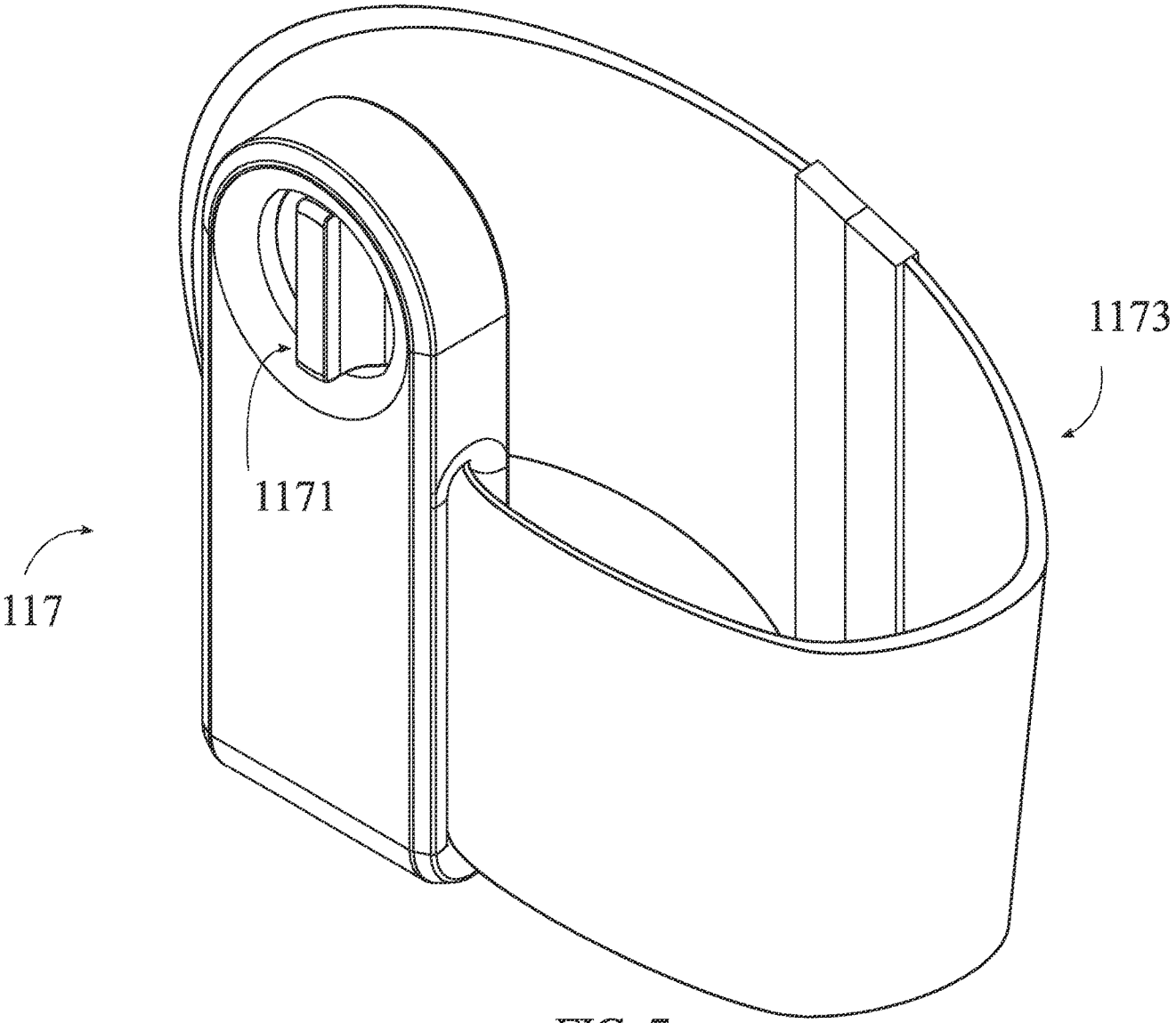
FIG. 7 a front perspective view of the clip.

The portable rowing machine 1 further comprises a clip 117, as shown in FIGS. 1 and 6-7. The clip 117 comprises at least one fastener 1171, a slot 1172 and a belt 1173. The clip 117 is removably attached to the backing 114 through the at least one fastener 1171. The slot 1172 traverses through the clip 117. The belt 1173 traverses through the slot 1172. In the preferred embodiment of the present invention, the clip 117 serves as a mounting adapter that allows the user to secure the portable rowing machine 1 along a suitable rigid pole structure or any other suitable rigid foundation, stand, or frame. The belt 1173 may take the form of a quick detach strap that allows the user to secure the clip 117 to a table leg or any other suitable rigid structure, such that the portable rowing machine 1 is sufficiently fixed for rowing exercises.

The portable rowing machine 1 further comprises a processing unit 23, a display 24, a user interface 29, and at least one sensor 25, as shown in FIG. 8. The control panel 113 is externally connected to the housing 11. The display 24 and the user interface 29 are connected adjacent to the control panel 113. The display 24, the user interface 29, and the at least one sensor 25 are electronically connected to the processing unit 23. In the preferred embodiment of the present invention, the processing unit 23 may take the form of an ergometer (ERG) monitor, such that the processing unit 23 measures the amount of work exerted along the portable rowing machine 1. The display 24 may take the form of an LCD/LED monitor that allows the user to view ERG related data. The user interface 29 may take the form of any suitable control interface that allows the user to navigate and configure the ERG recorder. In the preferred embodiment of the present invention, each of the at least one sensor 25 is positioned along the flywheel 14, such that the at least one sensor 25 records ERG related data.

The portable rowing machine 1 further comprises an anti-reversal mechanism 26, as shown in FIGS. 2, 4, and 5. The anti-reversal mechanism 26 is axially engaged between the pulley 12 and the planetary gear mechanism, where the anti-reversal mechanism 26 is configured to permit a first relative rotation direction between the pulley 12 and the planetary gear assembly 16 and prevent a second relative rotation direction between the pulley 12 and the planetary gear assembly 16. The anti-reversal mechanism 26 is axially engaged between the flywheel 14 and the planetary gear mechanism, where the anti-reversal mechanism 26 is configured to permit a first relative rotation direction between the flywheel 14 and the planetary gear assembly 16 and prevent a second relative rotation direction between the flywheel 14 and the planetary gear assembly 16. The anti-reversal mechanism 26 is axially engaged between the pulley shaft 13 and the pulley 12. The portable rowing machine 1 further comprises a flywheel hub 27. The anti-reversal mechanism 26 is axially engaged between the flywheel hub 27 and the planetary gear mechanism. In the preferred embodiment of the present invention, the anti-reversal mechanism 26 may take the form of a set of one-way bearings acting upon the pulley 12 and the flywheel 14. The portable rowing machine 1 further comprises a handle 28. The handle 28 is externally connected to the housing 11. The handle 28 allows the user to easily transport the portable rowing machine 1.

Although the invention has been explained in relation to its preferred embodiment, it is to be understood that many other possible modifications and variations can be made without departing from the spirit and scope of the invention as hereinafter claimed.

What is claimed is:

1. A portable rowing machine comprising:

a housing;

a pulley;

a flywheel;

a planetary gear assembly;

an anchor;

a retraction mechanism;

a pull cord;

a resistance mechanism;

the housing comprising a central gear support;

the pulley, the flywheel, the planetary gear assembly, and the retraction mechanism being positioned within the housing;

the central gear support being positioned within the housing;

the planetary gear assembly being positioned within the central gear support;

the pulley and the flywheel being axially connected opposite to each other along the planetary gear assembly;

the retraction mechanism being operatively connected to the pulley, wherein the retraction mechanism is configured to retract the pull cord into a spooled state around the pulley;

the anchor being externally connected to the housing;

the resistance mechanism comprising a carriage and at least one magnet;

the housing further comprising a carriage cavity;

the carriage being slidably positioned within the carriage cavity;

the at least one magnet being connected adjacent to the carriage cavity; and the at least one magnet being operatively engaged to the flywheel, wherein the at least one magnet is configured to provide magnetic resistance along the flywheel.

2. The portable rowing machine as claimed in claim 1 comprising:

an adjustment mechanism;

the adjustment mechanism comprising an adjustment element and a slider;

the slider being connected adjacent to the carriage; and the adjustment element being operatively engaged to the slider through the housing, wherein the adjustment mechanism is configured to adjust a distance between the at least one magnet and the flywheel.

3. The portable rowing machine as claimed in claim 2 comprising:

the adjustment mechanism traversing through the housing.

4. The portable rowing machine as claimed in claim 2 comprising:

the adjustment mechanism further comprising a pinion;

the slider comprising a rack;

the pinion being connected adjacent to the adjustment element;

the rack traversing across the slider; and the rack being operatively engaged with the pinion.

5. The portable rowing machine as claimed in claim 1 comprising:

the housing further comprising a control panel and a backing;

the anchor comprising an air pump, an air release, a hose, and a bladder;

the control panel and the backing being terminally positioned opposite to each other along the housing;

the air pump and the air release being positioned adjacent to the control panel;

the bladder being positioned adjacent to the backing; and the air pump and the air release being operatively connected to the hose; and the hose being in fluid communication between the air pump and the bladder.

6. The portable rowing machine as claimed in claim 1 comprising:

the housing further comprising a pulley enclosure and a flywheel enclosure;

the pulley enclosure and the flywheel enclosure being connected adjacent to the central gear support, opposite to each other along the central gear support;

the pulley being positioned between the central gear support and the pulley enclosure; and the flywheel being positioned between the central gear support and the flywheel enclosure.

7. The portable rowing machine as claimed in claim 6 comprising:

a flywheel fan;

the flywheel enclosure comprising a flywheel duct;

the flywheel duct traversing through the flywheel enclosure; and the flywheel fan being connected to the flywheel, opposite to the central gear support.

8. The portable rowing machine as claimed in claim 1 comprising:

the planetary gear assembly comprising an internal gear, a plurality of planet gears, and a sun gear;

the internal gear being connected within the central gear support;

the plurality of planet gears being engaged within the internal gear;

the sun gear being connected adjacent to the flywheel; and the sun gear being engaged within the plurality of planet gears, wherein the sun gear is engaged to the internal gear through the plurality of planet gears.

9. The portable rowing machine as claimed in claim 1 comprising:

a pulley shaft;

the planetary gear assembly comprising a gear spindle and a gear ring;

the gear spindle comprising a pulley shaft receiver;

the plurality of planet gears being connected between and radially distributed around the gear spindle and the gear ring;

the pulley shaft being axially connected to the pulley; and the pulley shaft being axially connected to the pulley shaft receiver.

10. The portable rowing machine as claimed in claim 1 comprising:

the housing further comprising a backing;

a clip;

the clip comprising at least one fastener, a slot and a belt;

the backing being externally connected to the housing;

the clip being removably attached to the backing through the at least one fastener;

the slot traversing through the clip; and the belt traversing through the slot.

11. The portable rowing machine as claimed in claim 1 comprising:

the housing further comprising a control panel;

a processing unit;

a display;

a user interface;

at least one sensor;

the control panel being externally connected to the housing;

the display and the user interface being connected adjacent to the control panel; and the display, the user interface, and the at least one sensor being electronically connected to the processing unit.

12. The portable rowing machine as claimed in claim 1 comprising:

an anti-reversal mechanism; and the anti-reversal mechanism being axially engaged between the pulley and the planetary gear mechanism, wherein the anti-reversal mechanism being configured to permit a first relative rotation direction between the pulley and the planetary gear assembly and prevent a second relative rotation direction between the pulley and the planetary gear assembly.

13. The portable rowing machine as claimed in claim 12 comprising:

a flywheel hub; and the anti-reversal mechanism being axially engaged between the flywheel hub and the planetary gear mechanism.

14. The portable rowing machine as claimed in claim 1 comprising:

an anti-reversal mechanism; and the anti-reversal mechanism being axially engaged between the flywheel and the planetary gear mechanism, wherein the anti-reversal mechanism being configured to permit a first relative rotation direction between the flywheel and the planetary gear assembly and prevent a second relative rotation direction between the flywheel and the planetary gear assembly.

15. The portable rowing machine as claimed in claim 14 comprising:

a pulley shaft; and the anti-reversal mechanism being axially engaged between the pulley shaft and the pulley.

16. The portable rowing machine as claimed in claim 1 comprising:

a handle; and the handle being externally connected to the housing.

* * * * *